US006701996B1

(12) United States Patent
Chen

(10) Patent No.: US 6,701,996 B1
(45) Date of Patent: Mar. 9, 2004

(54) ASSEMBLED AND CONVERTIBLE DECORATING ASSEMBLY

(76) Inventor: Wen-Ling Chen, No. 162, Lun-Mei Road, Changhua City (TW)

( * ) Notice: Subject to any disclaimer, the term of this patent is extended or adjusted under 35 U.S.C. 154(b) by 0 days.

(21) Appl. No.: 10/241,775

(22) Filed: Sep. 12, 2002

(51) Int. Cl.[7] ..... A47G 5/00
(52) U.S. Cl. ..... 160/135; 160/351; 160/377
(58) Field of Search ..... 160/130, 135, 160/351, 371, 377

(56) References Cited

U.S. PATENT DOCUMENTS 5,106,660 A * 4/1992 Vorel ..... 428/13
5,219,406 A * 6/1993 Raz ..... 160/135
5,274,970 A * 1/1994 Roberts ..... 52/126.2
5,287,909 A * 2/1994 King et al. ..... 160/135
5,642,593 A * 7/1997 Shieh ..... 52/239
5,695,261 A * 12/1997 Slesinger et al. ..... 312/223.6
5,881,789 A * 3/1999 Melashenko et al. ..... 160/135
6,105,322 A * 8/2000 Chang ..... 52/238.1
6,173,536 B1 * 1/2001 Boyce ..... 52/36.4
6,189,594 B1 * 2/2001 Carter ..... 160/135
6,206,079 B1 * 3/2001 Selgrad ..... 160/351
6,226,931 B1 * 5/2001 Haversat ..... 52/71
6,494,247 B1 * 12/2002 Pedone ..... 160/135
2002/0117270 A1 * 8/2002 Steeves et al. ..... 160/135

* cited by examiner

*Primary Examiner*—Bruce A. Lev
(74) *Attorney, Agent, or Firm*—Rosenberg, Klein & Lee

(57) ABSTRACT

An assembled and convertible decorating assembly includes at least three partition assemblies. Each partition assembly mainly includes several fixing elements, a pair of vertical rods, a pair of horizontal rods, a decorating element, and a pair of auxiliary horizontal rods. By several pivoting elements, this invention has the following three modes: a complete detached mode, a linear assembled mode that is a screen and an enclosed assembled mode that is an illuminating device. It is easy for storage or transportation. It can be assembled or re-arranged by the user. And, it has many functions such as a regular upright screen, an illuminating device, and an exhibition post, etc.

2 Claims, 6 Drawing Sheets

ASSEMBLED AND CONVERTIBLE DECORATING ASSEMBLY

BACKGROUND OF INVENTION

1. Field of the Invention

The present invention relates to an assembled and convertible decorating assembly. Particularly, it relates to an assembled and convertible decorating assembly that can be converted into a screen or an illuminating device. It is easy for storage or transportation. It can be assembled or re-arranged by the user. And, it has multiple functions.

2. Description of the Prior Art

Referring to FIGS. 1 and 2, the traditional screen 90 comprises several solid partition boards 91 (made by wood, rattan, etc.) and several pivoting elements 92 that are disposed between every two adjacent partition boards 92. So, this kind of traditional screen 90 can be used as a regular screen in a house. Usually, there are some drawing or writing on the partition boards 91 in order to increase the artistic atmosphere. However, the main disadvantages of the traditional screen 90 can be summarized as follows:

(1) It is not easy for storage or transportation. As shown in FIG. 2, usually the partition board 91 of the traditional screen 90 is made by hard materials like wood or rattan. Once it is folded, its volume is still quite large (length L, width W, Height H). Also, it is very heavy. Therefore, it is no easy for storage or transportation.

(2) The user cannot assemble or re-arrange it. When a user buys a traditional screen 90, this traditional screen 90 is a fixed structure that is difficult to disassemble. The user cannot enjoy the fun for assembling. In addition, the user cannot alter the drawing, writing or some decorating portion of the screen. The drawing or writing on the traditional screen 90 remains unchanged forever. It is very monotonous.

(3) There is only one function. The traditional screen 90 only has one single function that is used as a screen. It has no other function and cannot be converted into any other mode.

SUMMARY OF THE INVENTION

The primary object of the present invention is to provide an assembled and convertible decorating assembly. By the unique assembling design, this invention is easy for storage or transportation.

The other object of the present invention is to provide an assembled and convertible decorating assembly. It can be assembled or re-arranged by the user.

Another object of the present invention is to provide an assembled and convertible decorating assembly. It has multiple functions such as screen, indoor decoration, illuminating device, etc.

DETAILED DESCRIPTION OF THE PREFERRED EMBODIMENTS

Figure 5:
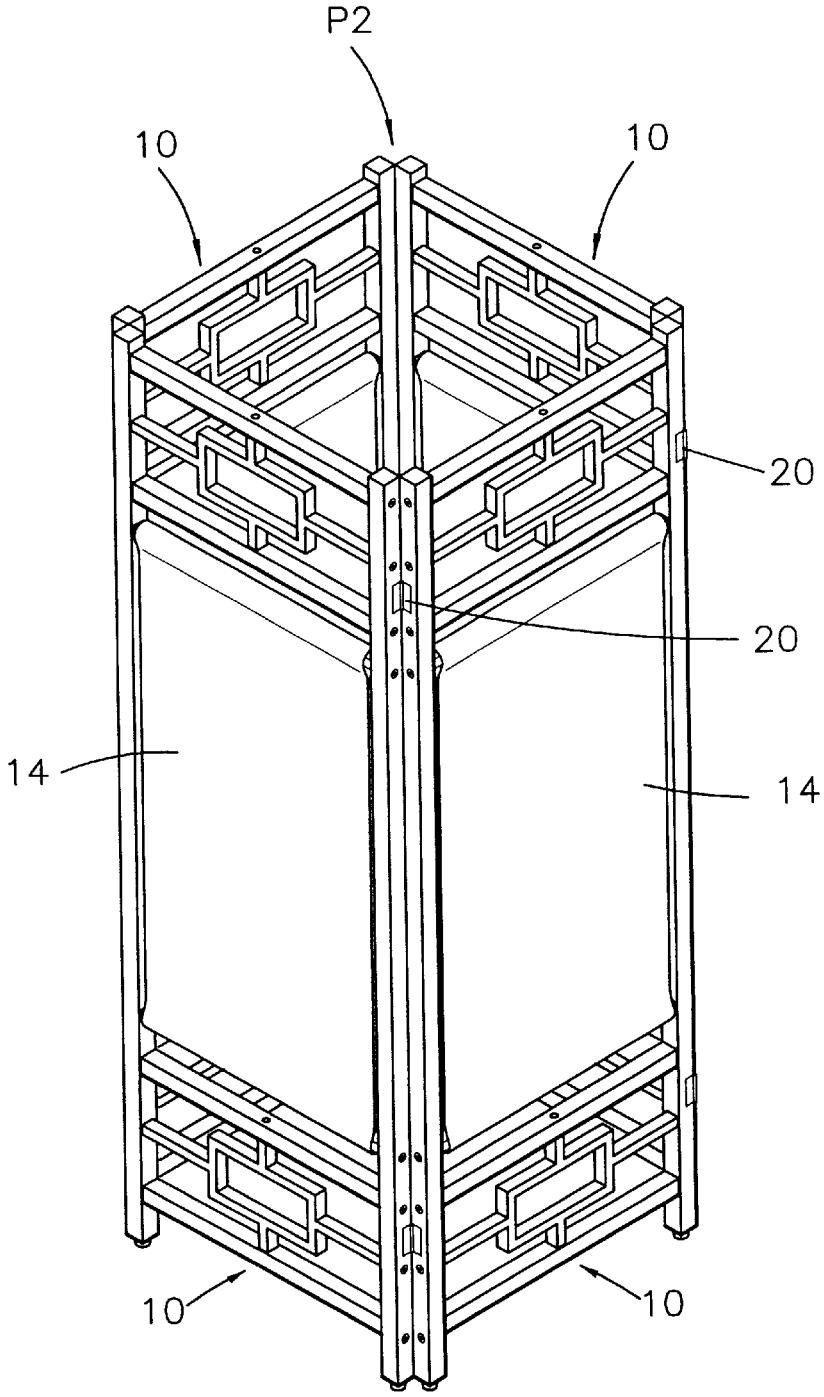
FIG. 5 is a perspective view of the second preferred embodiment of the present invention.

The present invention is an assembled and convertible decorating assembly. It includes at least three partition assemblies. Each assembled and convertible decorating assembly includes at least a complete detached mode, a linear assembled mode P1 (as shown in FIG. 3) and an enclosed assembled mode (as shown in FIG. 5).

Figure 1:
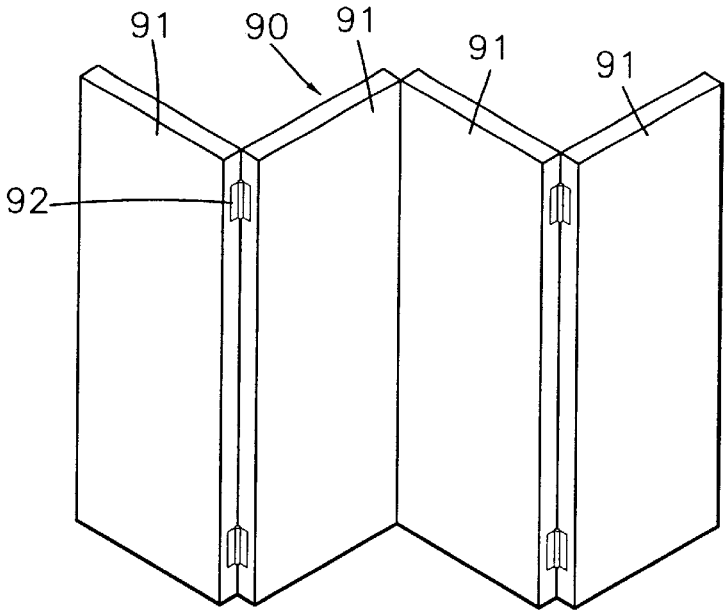
FIG. 1 (PRIOR ART)
FIG. 1 is a perspective view of the traditional screen.
Figure 2:
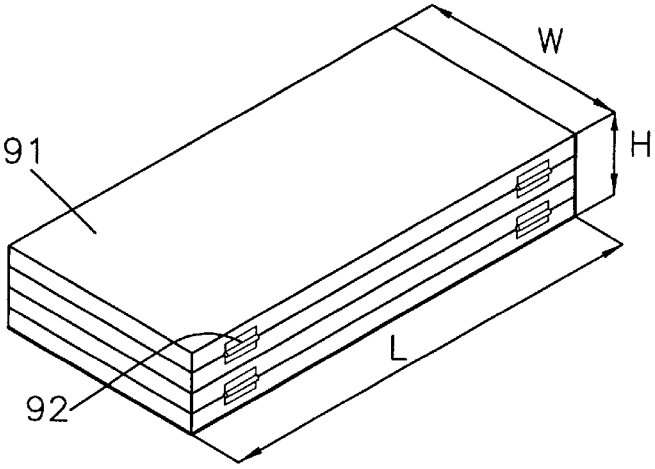
FIG. 2 (PRIOR ART)
FIG. 2 is a perspective view of the traditional screen when it is folded for storage.
Figure 3:
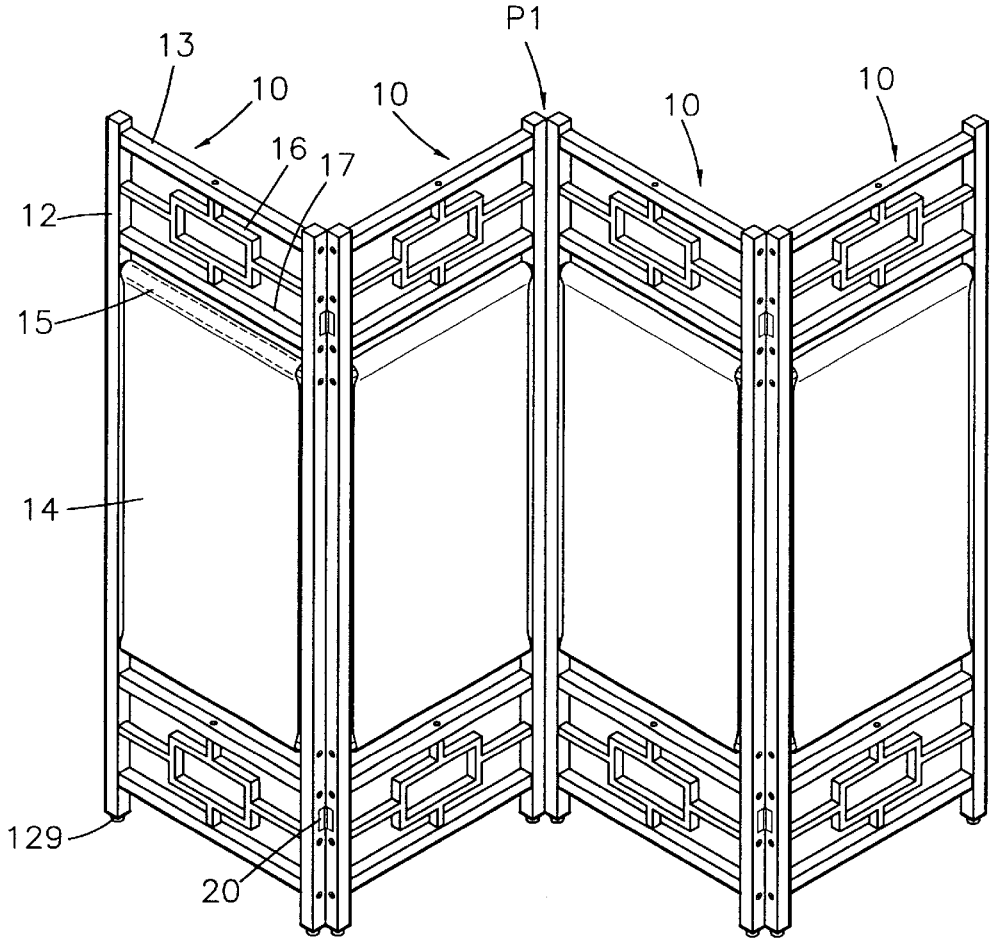
FIG. 3 is a perspective view of the first preferred embodiment of the present invention.
Figure 4:
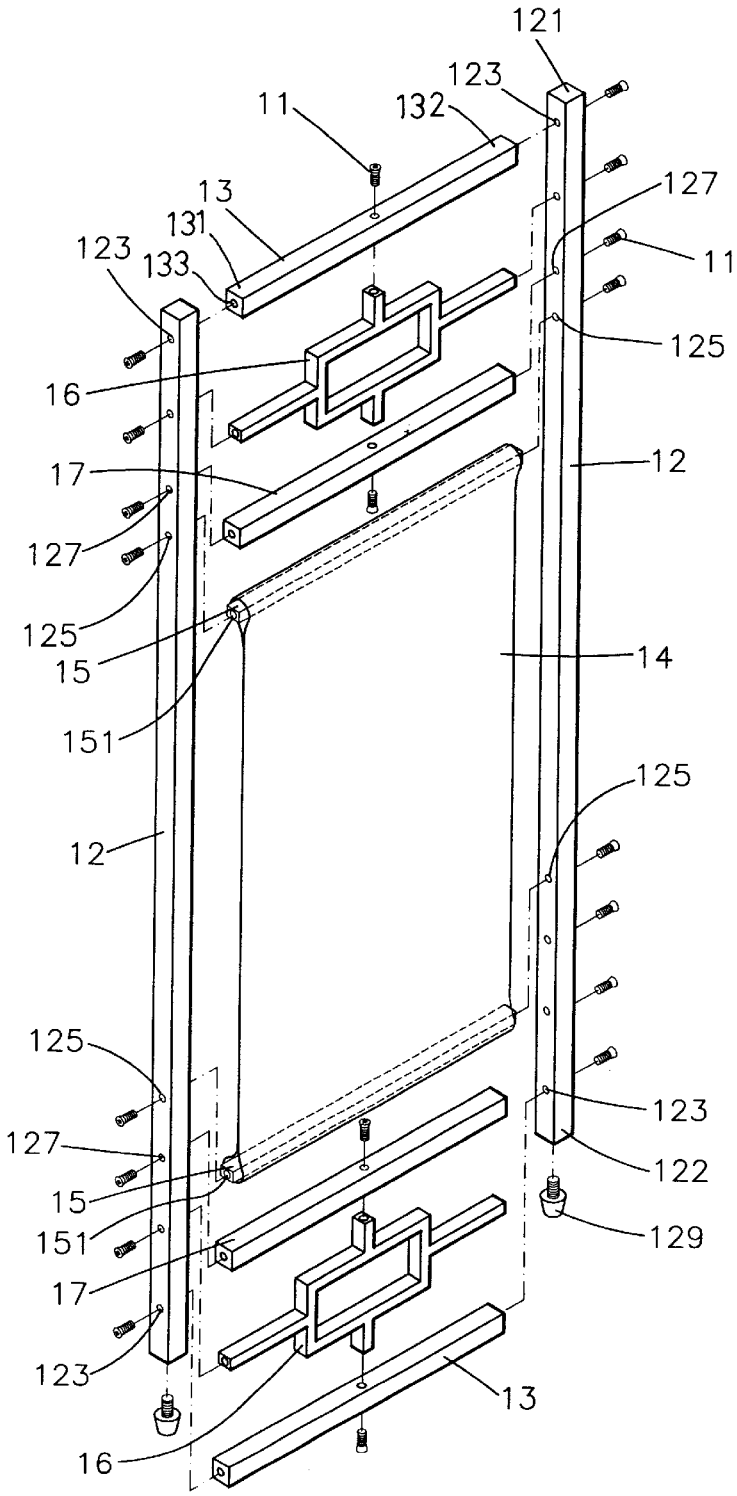
FIG. 4 is a perspective view of a selected portion of the present invention when it is disassembled.

Referring to FIGS. 3 and 4, it is the first preferred embodiment of this invention. In which, it includes four partition assemblies 10 for forming the linear assembled mode P1. Each partition assembly 10 comprises a plurality of fixing elements 11, a pair of vertical rods 12, a pair of horizontal rods 13, a decorating element 14, and an auxiliary horizontal rod 15.

The fixing elements 11 are detachable such as screws or bolts.

With regard to the vertical rods 12, each vertical rod 12 has a top 121 and a bottom 122. Two main structural holes 123 are disposed near the top 121 and the bottom 122 respectively.

About the horizontal rods 13, each horizontal rod 13 has a first end 131 and a second end 132. The first end 131 and the second end 132 have locking sections 133 respectively to provide the fixing elements 11 inserting through the main structural holes 123 and securing the horizontal rods 13 on the vertical rods 12 so that a substantially rectangular frame is formed.

The decorating element 14 is pliable (rolled or folded) and can be positioned within the frame.

In which, several pivoting elements 20 are disposed on outer flanges of two vertical rods 12 of the partition assembly 10 so as to pivot on adjacent partition assemblies 10.

Concerning the auxiliary horizontal rods 15, each vertical rod 12 has two auxiliary holes 125. Two ends of the auxiliary horizontal rod 15 have two auxiliary locking sections 151 respectively so that the corresponding fixing elements 11 can insert into the auxiliary holes 125 and the auxiliary horizontal rods 15 are secured on the vertical rods 12. And, the decorating element 14 is fixed between the auxiliary horizontal rods 15.

Also, there is a certain drawing or writing on the decorating element 14 (such as paper, cloth, etc.). Especially, the drawing could be the Chinese or Oriental wash painting, calligraphy, some meaningful words, poem, etc. Or, it can be a white paper so that the user can draw or write on it.

Thus, this assembled and convertible decorating assembly can be converted from a complete detached mode into a linear assembled mode P1. The linear assembled mode P1 means these assembled partition assemblies 10 are arranged as a regular upright screen.

Of course, each partition assembly 10 can further comprise at least one decorating frame 16. In this first preferred embodiment, there are two decorating frames 16 (top and bottom). They can be fixed between the pair of vertical rods 12. If the decorating frame 16 contains the simple squares and lines, it will provide a special feeling about Chinese culture or oriental style. Also, the user can replace other decorating frame 16 with different style.

Furthermore, each vertical rod 12 has two second structural holes 127. And, Each partition assembly 10 further includes a second horizontal rod 17. The decorating element 14 is positioned between the horizontal rod 13 and the second horizontal rod 17.

Therefore, in the first preferred embodiment, it can be assembled as a linear assembled mode P1 (a screen) as shown in FIG. 3. If the user wants to increase the width of the screen, the user can install extra pivoting element 20 to connect extra partition assemblies 10 so as to obtain a desired expanded width. For example, the screen can be assembled by six or eight partition assemblies 10.

When the user wants to store or move this invention, all the fixing elements 11 should be detached first. The decorating element 14 can be rolled so it will have a minimum volume. Because most of the components of this invention are rod-like elements, the total packing volume is small. It is easy for storage and transportation. Also, it can be manufactured as a DIY (Do-It-Yourself) product.

Figure 6:
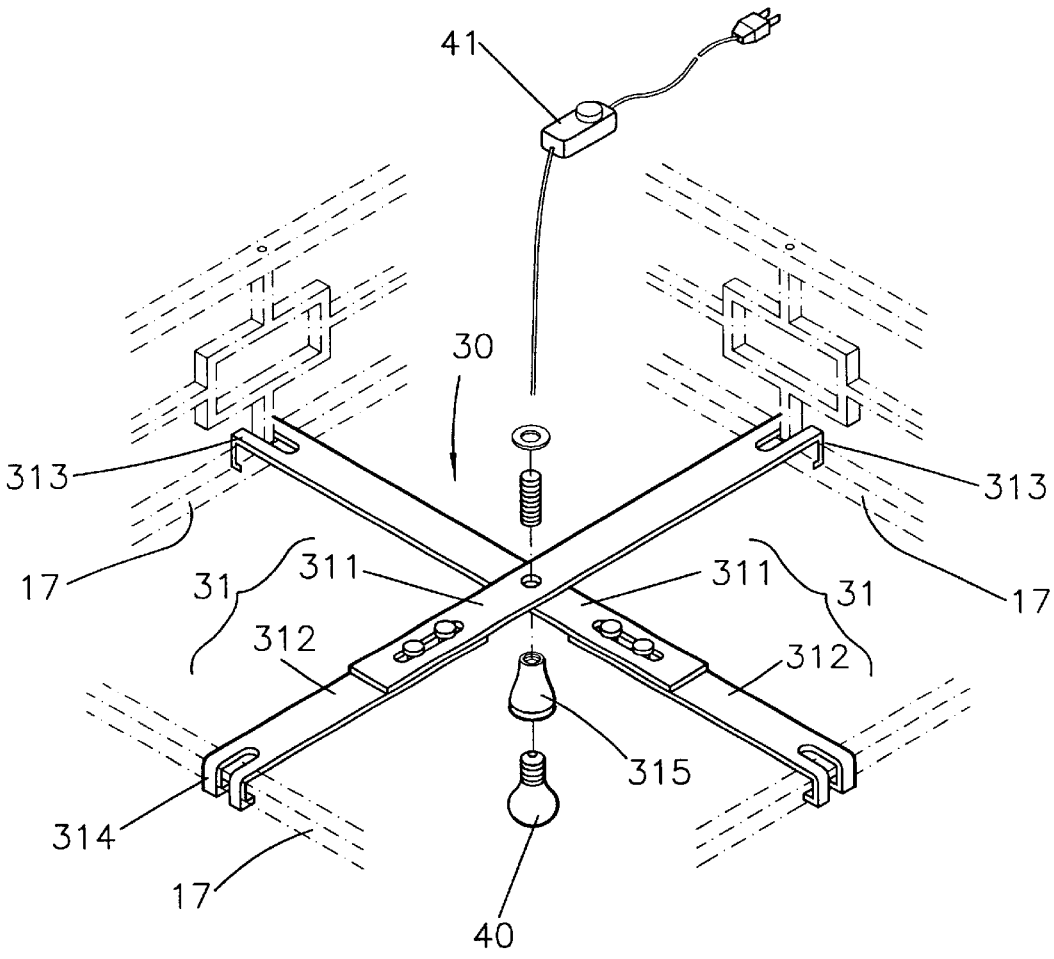
FIG. 6 is a perspective view of a selected portion of the present invention's second preferred embodiment.

Referring to FIGS. 5 and 6, it is the second preferred embodiment of the present invention. It also comprises four partition assemblies that are re-arranged as an enclosed assembled mode P2. Each partition assembly 10 comprises a plurality of fixing elements 11, a pair of vertical rods 12, a pair of horizontal rods 13, a decorating element 14, a pair of auxiliary horizontal rods 15, a decorating frame 16 and a second horizontal rod 17. In addition, it further comprises:

a light supporting set 30; and a light 40 secured on a light supporting set 30 so as to make the drawing or writing on the partition assembly 10 brighter.

In which, each vertical rod 12 has two second structural holes 127. Each partition assembly 10 includes a pair of second horizontal rods 17. In addition, the light supporting set 30 comprises two extendable rods 31. Two central portions of these two extendable rods 31 are pivoted with respect to each other. Each extendable rod 31 has a first plate 311 and a second plate 312 that is adjustably secured on the first plate 311. Two ends of each plate 311, 312 are disposed with hooks 313, 314 for securing on the corresponding second horizontal rods 17. And, a light seat 315 is disposed on the central portion of the extendable rod 17 for securing the light 40.

Of course, it can further comprise a dimmer 41 for controlling the light 40, so that the user can simply adjust the brightness of the light 40 to obtain a desired feeling.

As shown in FIG. 5, the second preferred embodiment is to form the enclosed assembled mode P2. The enclosed assembled mode P2 means the assembled partition assemblies 10 are arranged as an enclosed state having an isolated space therein. Basically, it can be used as an indoor decoration or an exhibition post. Or, it can enclose a vertical column (not shown) in the middle of a building.

Moreover, as shown in FIG. 6, depending on the user's need, this invention can further comprise a light 40 and a light supporting set 30. While the user turning on the light 40, the drawing or writing on the enclosed partition assemblies 10 will be brightened. It also can be placed in a dark space to create a romantic feeling. Therefore, it not only can be used at home, but also can be used in an office, studio, gallery, etc.

Figure 7:
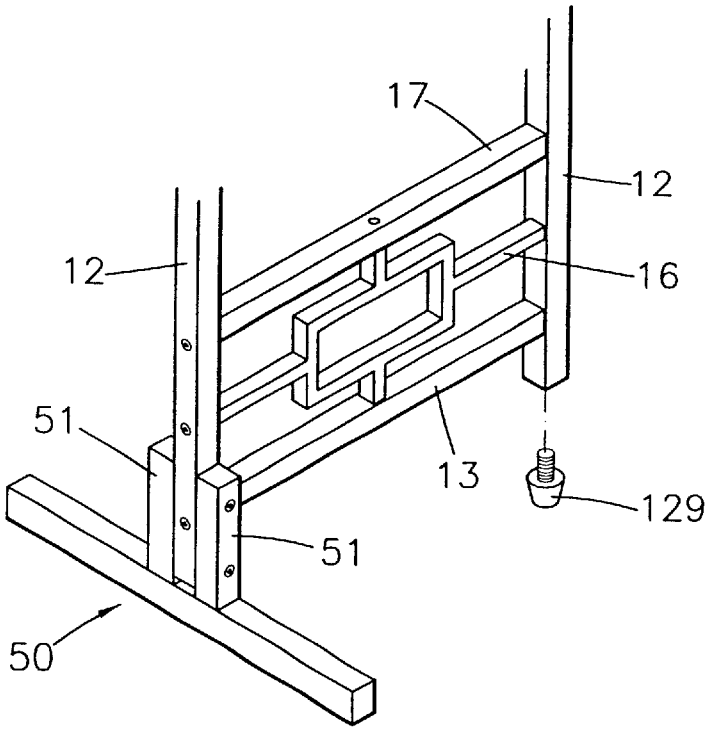
FIG. 7 shows the base of the present invention when the base is installed.
Figure 8:
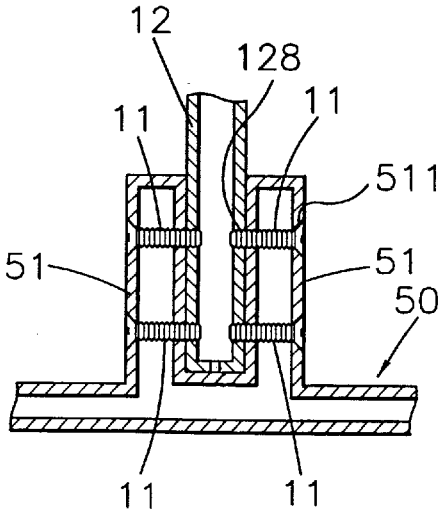
FIG. 8 shows the internal structure of the base of the present invention when the base is installed.

Of course, no matter in the first or the second preferred embodiment, the present invention can include a plurality of bases 50 in order to increase this invention's stability. As shown in FIGS. 7 and 8, the base 50 extends up a pair of protruded posts 52. These protruded posts 51 have several outer base holes 511. The bottom of the vertical rod 12 of the corresponding partition assembly 10 is disposed with several inner base holes 128 so that several fixing elements 11 can secure the base 50. Thus, the present invention is more stabilized.

In addition, the bottom of every vertical rod 12 can has screw hole for inserting a plastic pad 129. Thus, they can avoid to scratch the floor and to reduce the noise while moving this invention.

Thus, the advantages and functions of the present invention can be summarized as follows:

(1) It is easy for storage and transportation. Because this invention's structure can be assembled, it is easy to be detached. When this invention is totally detached, most of the components are rod-like structures. And, the decorating element 14 also can be rolled. It is very easy for storage and transportation.

(2) It can be assembled and re-arranged by the user. Because the present invention's structure is assembled, the user can do it by oneself. Thus, this invention can be manufactured as a DIY (Do-It-Yourself) product. Plus, the decorating frame 16 and the decorating element 14 can be replaced by the user for cleaning or changing decorating style. Furthermore, the total width of the screen can be expanded. Therefore, this invention is very flexible.

(3) It has multiple functions. The present invention not only can be arranged as a screen, but also can be re-arranged as the enclosed assembled mode P2. Besides, once a light is added, it will become an indoor illuminating device. If the light is not added, it will become an indoor decoration, exhibition post or an enclosure for a column in the middle of a building.

The above embodiments are only used to illustrate the present invention, not intended to limit the scope thereof. Many modifications of the above embodiments can be made without departing from the spirit of the present invention.

What is claimed is:

1. An assembled and convertible decorating assembly comprising:

at least three partition assemblies, each partition assembly including:

a. a detachable fixing element;

b. a pair of vertical rods, each vertical rod having a top and a bottom, two main structural holes being respectively disposed near said top and bottom of the vertical rod, each vertical rod having two second structural holes;

c. a pair of horizontal rods, each horizontal rod having a first end and a second end, said first end and second end each having a locking section formed therein to respectively provide for securing said horizontal rods to said vertical rods, said fixing elements being inserted through a respective one of said main structural holes to engage a corresponding one of said locking sections and form a substantially rectangular frame;

d. a pair of second horizontal rods;

e. a pliable decorating element positioned within said frame, said decorating element having indicia of a predetermined configuration; and, f. a plurality of pivoting elements disposed on an outer flange of at least one of said pair of vertical rods of said partition assembly for pivoting said partition assembly relative to an adjacent one said other partition assemblies;

said assembled and convertible decorating assembly having at least a complete detached mode, a linear assembled mode and an enclosed assembled mode, said complete detached mode being defined by the above mentioned elements being detached, said linear assembled mode being defined by said assembled partition assemblies being arranged as a regular upright screen, said enclosed assembled mode being defined by said assembled partition assemblies being arranged in an enclosed state having an isolated space therein;

a light supporting set secured on at least two horizontal rods of two oppositely disposed partition assemblies in said enclosed assembled mode, said light supporting set including two extendable rods, two central portions of said two extendable rods being pivoted with respect to each other, each extendable rod having a first plate and a second plate that is secured on said first plate, two ends of each plate are disposed with hooks respectively for securing on said corresponding second horizontal rods, and a light seat is disposed on the central portion of each extendable rod; and a light fixed on said light seat of said light supporting set for illuminating said indicia on said decorating element.

2. The assembled and convertible decorating assembly as claimed in claim 1, further comprising a dimmer for controlling the light.

* * * * *